United States Patent [19]

Kukes et al.

[11] Patent Number: 4,959,140

[45] **Date of Patent: * Sep. 25, 1990**

[54] TWO-CATALYST HYDROCRACKING PROCESS

[75] Inventors: Simon G. Kukes, Naperville; Louis C. Gutberlet, Wheaton, both of Ill.; Albert L. Hensley, Munster, Ind.

[73] Assignee: Amoco Corporation, Chicago, Ill.

[ * ] Notice: The portion of the term of this patent subsequent to Oct. 24, 2006 has been disclaimed.

[21] Appl. No.: 328,577

[22] Filed: Mar. 27, 1989

[51] Int. Cl.[5] ..... C10G 65/10

[52] U.S. Cl. ..... 208/59; 208/58; 208/111; 208/112; 208/210

[58] Field of Search ..... 208/59, 58, 111, 112, 208/89, 210

[56] References Cited

U.S. PATENT DOCUMENTS 4,834,865 5/1989 Kukes et al. ..... 208/59

4,875,991 10/1989 Kukes et al. ..... 208/59

FOREIGN PATENT DOCUMENTS 0223163 6/1985 German Democratic Rep. ... 208/59

*Primary Examiner*—Chung K. Pak

*Attorney, Agent, or Firm*—Ekkehard Schoettle; William H. Magidson; Ralph C. Medhurst

[57] ABSTRACT

Disclosed is a hydrocracking process wherein the feedstock is contacted in a first reaction zone with a first reaction zone catalyst comprising a nickel component and a tungsten component deposed on a support component consisting essentially of an alumina component and a crystalline molecular sieve component. The effluent from the first reaction zone effluent is then contacted in a second reaction zone with a second reaction zone catalyst comprising a cobalt component and a molybdenum component deposed on a support component comprising an alumina component and a crystalline molecular sieve component.

11 Claims, 1 Drawing Sheet

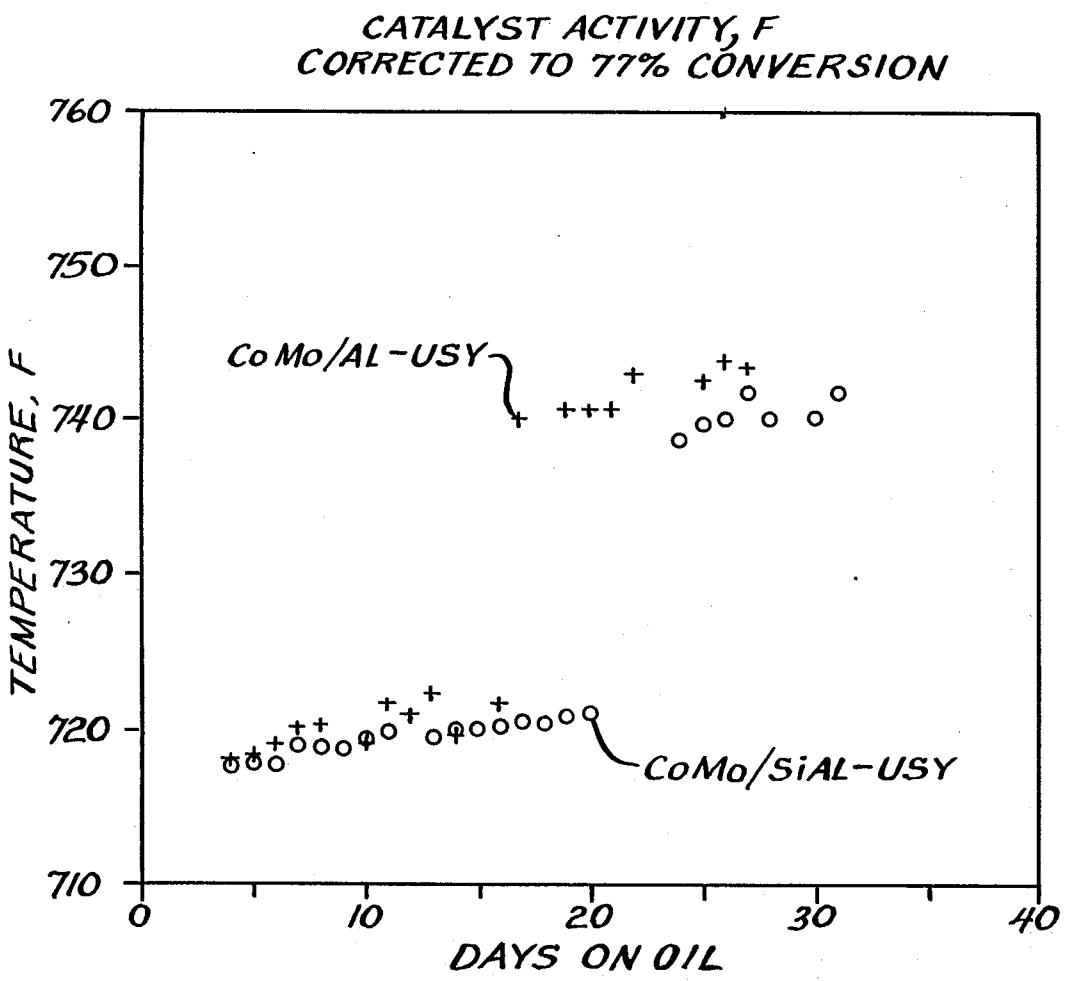
CATALYST ACTIVITY, F
CORRECTED TO 77% CONVERSION
CoMo/AL-USY
CoMo/SiAL-USY
TEMPERATURE, F
760
750
740
730
720
710
0
10
20
30
40
DAYS ON OIL

TWO-CATALYST HYDROCRACKING PROCESS

BACKGROUND OF THE INVENTION

The present invention relates to a hydrocarbon conversion process. More particularly, this invention relates to the catalytic hydrocracking of hydrocarbons.

The hydrocracking of hydrocarbons is old and well-known in the prior art. These hydrocracking processes can be used to hydrocrack various hydrocarbon fractions such as reduced crudes, gas oils, heavy gas oils, topped crudes, shale oil, coal extract and tar extract wherein these fractions may or may not contain nitrogen compounds. Modern hydrocracking processes were developed primarily to process feeds having a high content of polycyclic aromatic compounds, which are relatively unreactive in catalytic cracking. The hydrocracking process is used to produce desirable products such as turbine fuel, diesel fuel, and light distillate products such as naphtha and gasoline.

The hydrocracking process is generally carried out in any suitable reaction vessel under elevated temperatures and pressures in the presence of hydrogen and a hydrocracking catalyst so as to yield a product containing the desired distribution of hydrocarbon products.

Hydrocracking catalysts generally comprise a hydrogenation component on an acidic cracking support. More specifically, hydrocracking catalysts comprise a hydrogenation component selected from the group consisting of Group VIB metals and Group VIII metals of the Periodic Table of Elements, their oxides or sulfides. The prior art has also taught that these hydrocracking catalysts contain an acidic support comprising a crystalline aluminosilicate material such as X-type and Y-type aluminosilicate materials. This crystalline aluminosilicate material is generally suspended in a refractory inorganic oxide such as silica, alumina, or silica-alumina.

Regarding the hydrogenation component, the preferred Group VIB metals are tungsten and molybdenum; the preferred Group VIII metals are nickel and cobalt. The prior art has also taught that combinations of metals for the hydrogenation component, expressed as oxides and in the order of preference, are: $NiO-WO_3$, $NiO-MoO_3$, $CoO-MoO_3$, and $CoO-WO_3$. Other hydrogenation components broadly taught by the prior art include iron, ruthenium, rhodium, palladium, osmium, indium, platinum, chromium, vanadium, niobium, and tantalum.

References that disclose hydrocracking catalysts utilizing nickel and tungsten as hydrogenation components, teach enhanced hydrocracking activity when the matrix or catalyst support contains silica-alumina. For instance, U.S. Pat. Nos. 4,576,711, 4,563,434, and 4,517,073 all to Ward et al., each show at Table V thereof, that the lowest hydrocracking activity is achieved when alumina is used in the support instead of a dispersion of silica-alumina in alumina. The lowest hydrocracking activity is indicated by the highest reactor temperature required to achieve 60 vol. % conversion of the hydrocarbon components boiling above a predetermined end point to below that end point.

Similarly, U.S. Pat. No. 3,536,605 to Kittrell et al. teaches the use of silica-alumina in the catalyst support when a nickel- and tungsten-containing hydrogenation component is employed.

U.S. Pat. No. 3,598,719 to White teaches a hydrocracking catalyst that can contain 0 wt. % silica, however, the patent does not present an example showing the preparation of a catalyst devoid of silica nor does the patent teach the preferential use of nickel and tungsten as hydrogenation metals.

As can be appreciated from the above, there is a myriad of catalysts or catalyst systems known for hydrocracking whose properties vary widely. A catalyst suitable for maximizing naphtha yield may not be suitable for maximizing the yield of turbine fuel or distillate. Further, various reactions; i.e., denitrogenation, hydrogenation, and hydrocracking must be reconciled in a hydrocracking process in an optimum manner to achieve the desired results.

For instance when a feedstock having a high nitrogen content is exposed to a hydrocracking catalyst containing a high amount of cracking component the nitrogen serves to poison or deactivate the cracking component. Thus, hydrodenitrogenation catalysts do not possess a high cracking activity since they are generally devoid of a cracking component that is capable of being poisoned. Another difficulty is presented when the hydrocracking process is used to maximize naphtha yields from a feedstock containing light catalytic cycle oil which has a very high aromatics content. The saturation properties of the catalyst must be carefully gauged to saturate only one aromatic ring of a polynuclear aromatic compound such as naphthalene in order to preserve desirable high octane value aromatic-containing hydrocarbons for the naphtha fraction. If the saturation activity is too high, all of the aromatic rings will be saturated and subsequently cracked to lower octane value paraffins.

On the other hand, distillate fuels such as diesel fuel or aviation fuel have specifications that stipulate a low aromatics content. This is due to the undesirable smoke production caused by the combustion of aromatics in diesel engines and jet engines.

Prior art processes designed to convert high nitrogen content feedstocks are usually two stage processes wherein the first stage is designed to convert organic nitrogen compounds to ammonia prior to contacting with a hydrocracking catalyst which contained a high amount of cracking component; i.e., a molecular sieve material.

For instance U.S. Pat. No. 3,923,638 to Bertolacini et al. discloses a two catalyst process suitable for converting a hydrocarbon containing substantial amounts of nitrogen to saturated products adequate for use as jet fuel. Specifically, the subject patent discloses a process wherein the hydrodenitrogenation catalyst comprises as a hydrogenation component a Group VIB metal and Group VIII metal and/or their compounds and a cocatalytic acidic support comprising a large-pore crystalline aluminosilicate material and refractory inorganic oxide. The hydrocracking catalyst comprises as a hydrogenation component a Group VIB metal and a Group VIII metal and/or their compounds, and an acidic support of large-pore crystalline aluminosilicate material. For both hydrodenitrogenation catalyst and the hydrocracking catalyst, the preferred hydrogenation component comprises nickel and tungsten and/or their compounds and the preferred large-pore crystalline aluminosilicate material is ultrastable, largepore crystalline aluminosilicate material.

Another two catalyst hydrocracking process is disclosed in U.S. Pat. No. 4,211,634 to Bertolacini et al. The subject patent discloses a process which employes a first catalyst comprising a specific hydrogenation component comprising nickel and molybdenum or tungsten and as the second catalyst a catalyst comprising a specific hydrogenation component comprising cobalt and molybdenum, each of the catalysts also comprising a co-catalytic acidic cracking component comprising an ultrastable, large-pore crystalline aluminosilicate material dispersed in and suspended throughout a silica-alumina matrix.

The first catalyst in the above disclosed two-catalyst hydrocracking process has been significantly improved as disclosed in application 124,280, filed Nov. 23, 1987, now U.S. Pat. No. 4,820,403, when used to convert light catalytic cycle oils containing a substantial amount of aromatics. Specifically, the subject application, the teachings of which are incorporated by reference discloses a catalyst comprising a combination of a nickel component and a tungsten component coupled with a support component containing an alumina component to the exclusion of any other inorganic refractory oxide. This catalyst system provides increased selectivity towards high octane naphtha with decreased undesirable selectivity towards $C_1$ to $C_5$ light gas.

The second catalyst disclosed in U.S. Pat. No. 4,211,634 has also been investigated and compared with other catalysts as shown in U.S. Pat. No. 3,649,523 to Bertolacini et al. Specifically, the example accompanying the '523 patent shows that a hydrocracking catalyst containing cobalt and molybdenum supported on a silica-alumina matrix has a much higher hydrocracking activity than a catalyst wherein the support component comprises alumina. The alumina containing catalyst, however, afforded a much higher naphtha yield.

It has now been discovered that when the matrix of the second catalyst in series in a two-catalyst hydrocracking process contains alumina as the sole refractory inorganic oxide and is employed with a first catalyst wherein the matrix similarly contains alumina, the heavy naptha yield can be considerably improved with a negligible or no loss in activity. This is in contradistinction to the teachings of the '523 patent wherein the use of alumina with a cobalt and molybdenum-containing catalyst results in an activity debit.

The process of the invention affords a substantially similar product quality and deactivation rate as compared to a two-catalyst hydrocracking process wherein silicaalumina is employed as the matrix component in the second catalyst.

SUMMARY OF THE INVENTION

This invention relates to a two-catalyst process for hydrocracking a hydrocarbon feedstock with hydrogen at hydrocracking conversion conditions in a plurality of reaction zones in series.

Specifically, the feedstock is contacted in a first reaction zone with a first reaction zone catalyst comprising a nickel component and a tungsten component deposed on a support component consisting essentially of an alumina component and a crystalline molecular sieve component. The effluent from the first reaction zone effluent is then contacted in a second reaction zone with a second reaction zone catalyst comprising a cobalt component and a molybdenum component deposed on a support component comprising an alumina component and a crystalline molecular sieve component.

BRIEF DESCRIPTION OF THE DRAWING

The accompanying FIGURE depicts the catalyst activity for the two-catalyst process of the invention as compared with an alternative two-catalyst process.

DETAILED DESCRIPTION OF THE INVENTION

The hydrocarbon charge stock subject to hydrocracking in accordance with the process of this invention is suitably selected from the group consisting of petroleum distillates, solvent deasphalted petroleum residua, shale oils and coal tar distillates. These feedstocks typically have a boiling range above about 200° F. and generally have a boiling range between 350 to 950° F. More specifically these feedstocks include heavy distillates, heavy straight-run gas oils and heavy cracked cycle oils, as well as fluidized catalytic cracking unit feeds. The process of the invention is especially suitable in connection with handling feeds that include a light catalytic cycle oil. This light catalytic cycle oil generally has a boiling range of about 350° to about 750° F., a sulfur content of about 0.3 to about 2.5 wt %, a nitrogen content of about 0.01 to about 0.15 wt % and an aromatics content of about 40 to about 90 vol. %. The light catalytic cycle oil is a product of the fluidized catalytic cracking process.

Operating conditions to be used in each hydrocracking reaction zone in the process of the invention include an average catalyst bed temperature within the range of about 500° to 1000° F., preferably 600° to 900° F. and most preferably about 650° to about 850° F., a liquid hourly space velocity within the range of about 0.1 to about 10 volumes hydrocarbon per hour per volume catalyst, a total pressure within the range of about 500 psig to about 5,000 psig, and a hydrogen circulation rate of about 500 standard cubic feet to about 20,000 standard cubic feet per barrel.

The process of the present invention is naphtha selective with decreased production of light gases.

In the process of the invention, each reaction zone can comprise one or a plurality of beds that have intrabed quench to control temperature rise due to the exothermic nature of the hydrocracking reactions. The charge stock may be a liquid, vapor, or liquid-vapor phase mixture, depending upon the temperature, pressure, proportion of hydrogen, and particular boiling range of the charge stock processed. The source of the hydrogen being admixed can comprise a hydrogen-rich gas stream obtained from a catalytic reforming unit.

The catalysts used in the process of the present invention comprise a hydrogenation component and a catalyst support.

The hydrogenation component of the catalysts employed in the process of the invention comprise a Group VIB metal component and a Group VIII metal component. These components are typically present in the oxide or sulfide form.

The hydrogenation component of the first reaction zone catalyst comprises nickel and tungsten and/or their compounds. The nickel and tungsten are present in the amounts specified below. These amounts are based on the total catalytic composite or catalyst weight and are calculated as the oxides, NiO and $WO_3$. In another embodiment of the present invention, the hydrogenation component can additionally comprise a phosphorus component. The amount of phosphorus component is calculated as $P_2O_5$ with the ranges thereof also set out below.

| | Broad | Preferred | Most Preferred |
|---|---|---|---|
| NiO, wt % | 1–10 | 1.5–5.0 | 1.5–4.0 |
| $WO_3$, wt % | 10–30 | 15–25 | 15–20 |
| $P_2O_5$, wt % | 0.0–10.0 | 0.0–6.0 | 0.0–3.0 |

Another component of the first reaction zone catalytic composite or catalyst is the support. The support contains a crystalline molecular sieve material and alumina. The preferred alumina is gamma alumina. The crystalline molecular sieve material is present in an amount ranging from about 25 to about 60 wt. %, preferably from about 35 to about 50 wt % based on total support weight.

Preferably, the crystalline molecular sieve material is distributed throughout and suspended in a porous matrix of the alumina. The use of alumina in the first zone catalyst support is in contradistinction to U.S. Pat. Nos. 4,576,711, 4,563,434, and 4,517,073 to Ward et al. and U.S. Pat. No. 3,536,605 to Kittrell et al. which require the presence of silica-alumina matrix material. The use of alumina is preferred in the first zone catalyst because it serves to increase hydrogenation activity as opposed to hydrocracking activity. It is preferable to carry out hydrogenation reactions prior to the hydrocracking reactions because the hydrocracking reaction will take place at a faster rate with hydrogenated reactants.

The hydrogenation component of the second reaction zone catalyst comprises cobalt and molybdenum and/or their compounds, these metals are present in the amounts specified below. These amounts are based on the total catalytic composite or catalyst weight and are calculated as the oxides CoO and $MoO_3$.

| | Broad | Preferred | Most Preferred |
|---|---|---|---|
| CoO, wt. % | 1–6 | 1.5–5 | 2–4 |
| $MoO_3$, wt. % | 3–20 | 6–15 | 8–12 |

In another embodiment of the present invention, the second reaction zone catalyst can additionally comprise a phosphorus component. This phosphorus component can be present in an amount ranging from 0.0 to about 15 wt. %, preferably 0.0 to about 10 wt. % and most preferably from 0.0 to about 5.0 wt. %, based on total catalyst weight and calculated as the oxide $P_2O_5$.

The second reaction zone support comprises a crystalline molecular sieve component and an alumina component. The crystalline molecular sieve material is present in an amount ranging from about 10 to 60 wt % and preferably from about 25 to 50 wt %. The preferred alumina is gamma alumina.

In all cases the hydrogenation component may be deposited upon the support by impregnation employing heatdecomposable salts of the above-described metals or any other method known to those skilled in the art. Each of the elements may be impregnated onto the support separately, or they may be co-impregnated onto the support. The composites are subsequently dried and calcined to decompose the salts.

The supports may be prepared by various well-known methods and formed into pellets, beads, and extrudates of the desired size For example, the crystalline molecular sieve material may be pulverized into finely divided material, and this latter material may be intimately admixed with the refractory inorganic oxide. The finely divided crystalline molecular sieve material may be admixed thoroughly with a hydrosol or hydrogel of the inorganic oxide. Where a thoroughly blended hydrogel is obtained, this hydrogel may be dried and broken into pieces of desired shapes and sizes. The hydrogel may also be formed into small spherical particles by conventional spray drying techniques or equivalent means.

The molecular sieve materials of the invention preferably are selected from the group consisting of faujasite-type crystalline aluminosilicates, and mordenite-type crystalline aluminosilicates. Although not preferred, crystalline aluminosilicates such as ZSM-5, ZSM-11, ZSM-12, ZSM-23, and ZSM-35, and crystalline borosilicate molecular sieves such as AMS-1B can also be used with varying results alone or in combination with the faujasitetype or mordenite-type crystalline aluminosilicate. Also suitable for use are gallosilicates in conjunction with another molecular sieve component. Specifically, application Ser. No. 287,399, filed Dec. 20, 1988, discloses a hydrocracking catalyst containing a molecular sieve material present in an amount ranging from about 25 to about 60 wt. % based on the weight of the support component wherein at least about 1 to about 80 wt. % of the sieve material is gallosilicate.

Examples of a faujasite-type crystalline aluminosilicate are low-alkali metal Y-type crystalline aluminosilicates, metal-exchanged X-type and Y-type crystalline aluminosilicates, and ultrastable, large-pore crystalline aluminosilicate material Zeolon is an example of a mordenite-type crystalline aluminosilicate.

An ultrastable, large-pore crystalline aluminosilicate material is represented by Z-14US zeolites which are described in U.S. Pat. Nos. 3,293,192 and 3,449,070. Each of these patents is incorporated by reference herein and made a part hereof. By large-pore material is meant a material that has pores which are sufficiently large to permit the passage thereinto of benzene molecules and larger molecules and the passage therefrom of reaction products. For use in petroleum hydrocarbon conversion processes, it is often preferred to employ a large-pore molecular sieve material having a pore size of at least 5 Å (0.5 nm) to 10 Å (1 nm).

The ultrastable, large-pore crystalline aluminosilicate material is stable to exposure to elevated temperatures. This stability at elevated temperatures is discussed in the aforementioned U.S. Pat. Nos. 3,293,192 and 3,449,070. It may be demonstrated by a surface area measurement after calcination at 1,725° F. In addition, the ultrastable, large-pore crystalline aluminosilicate material exhibits extremely good stability toward wetting, which is defined as the ability of a particular aluminosilicate material to retain surface area or nitrogen-adsorption capacity after contact with water or water vapor. A sodium-form of the ultrastable, large-pore crystalline aluminosilicate material (about 2.15 wt. % sodium) was shown to have a loss in nitrogen-absorption capacity that is less than 2% per wetting, when tested for stability to wetting by subjecting the material to a number of consecutive cycles, each cycle consisting of a wetting and a drying.

The ultrastable, large-pore crystalline aluminosilicate material that is preferred for the catalytic composition of this invention exhibits a cubic unit cell dimension and hydroxyl infrared bands that distinguish it from other aluminosilicate materials. The cubic unit cell dimension of the preferred ultrastable, large-pore crystalline aluminosilicate is within the range of about 24.20 Angstrom units (Å) to about 24.55 Å. The hydroxyl infrared bands obtained with the preferred ultrastable, large-pore crystalline aluminosilicate material are a band near 3,745 $cm^{-1}$ (3,745±5 $cm^{-1}$), a band near 3,695 $cm^{-1}$ (3,690±10 $cm^{-1}$), and a band near 3,625 $cm^{-1}$ (3,610±15 $cm^{-1}$). The band near 3,745 $cm^{-1}$ may be found on many of the hydrogen-form and decationized aluminosilicate materials, but the band near 3,695 $cm^{-1}$ and the band near 3,625 $cm^{-1}$ are characteristic of the preferred ultrastable, large-pore crystalline aluminosilicate material that is used in the catalyst of the present invention.

The ultrastable, large-pore crystalline aluminosilicate material is characterized also by an alkali metal content of less than 1%.

Another example of a crystalline molecular sieve zeolite that can be employed in the catalytic composition of the present invention is a metal-exchanged Y-type molecular sieve. Y-type zeolitic molecular sieves are discussed in U.S. Pat No. 3,130,007. The metal-exchanged Y-type molecular sieve can be prepared by replacing the original cation associated with the molecular sieve by a variety of other cations according to techniques that are known in the art. Ion exchange techniques have been disclosed in many patents, several of which are U.S. Pat. Nos. 3,140,249, 3,140,251, and 3,140,253. Specifically, a mixture of rare earth metals can be exchanged into a Y-type zeolitic molecular sieve and such a rare earth metal-exchanged Y-type molecular sieve can be employed suitably in the catalytic composition of the present invention. Specific examples of suitable rare earth metals are cerium, lanthanum, and praseodymium.

As mentioned above, another molecular sieve that can be used in the catalytic compositions of the present invention is AMS-1B crystalline borosilicate, which is described in U.S. Pat. No. 4,269,813, which patent is incorporated by reference herein and made a part hereof.

A suitable AMS-1B crystalline borosilicate is a molecular sieve material having the following composition in terms of mole ratios of oxides:

$$0.9 \pm 0.2\ M_{2/n}O + B_2O_3 + YSiO_2 + ZH_2O,$$

wherein M is at least one cation having a valence of n, Y is within the range of 4 to about 600, and Z is within the range of 0 to about 160, and providing an X-ray diffraction pattern comprising the following X-ray diffraction lines and assigned strengths:

| d(Å) | Assigned Strength |
|---|---|
| 11.2 ± 0.2 | W-VS |
| 10.0 ± 0.2 | W-MS |
| 5.97 ± 0.07 | W-M |
| 3.82 ± 0.05 | VS |
| 3.70 ± 0.05 | MS |
| 3.62 ± 0.05 | M-MS |
| 2.97 ± 0.02 | W-M |
| 1.99 ± 0.02 | VW-M |

Mordenite-type crystalline aluminosilicates can be employed in the catalyst of the present invention. Mordenite-type crystalline aluminosilicate zeolites have been discussed in patent art, e.g., by Kimberlin in U.S. Pat. No. 3,247,098, by Benesi, et al., in U.S. Pat. No. 3,281,483, and by Adams, et al., in U.S. Pat. No. 3,299,153. Those portions of each of these patents which portions are directed to mordenite-type aluminosilicates are incorporated by reference and made a part hereof.

The catalysts used in the present invention can be used in any form such as pellets, spheres, extrudates, or other shapes having particular cross sections such as a clover leaf, or "C" shape.

In accordance with the process of the invention, the preferred amounts of catalyst in each respective zone are set out below as a percentage range of the overall amount of catalyst used in the process.

| | Broad | Preferred |
|---|---|---|
| Zone 1 | 20–80 | 40–60 |
| Zone 2 | 10–80 | 25–50 |

In a preferred embodiment of the present invention the catalyst situated at the downstream portion of the plurality of reaction zones possesses a small nominal size while the remaining upstream portion of the total amount of catalyst possesses a large nominal size greater than the small nominal size catalyst. Specifically, the small nominal size is defined as catalyst particles having a U.S. Sieve mesh size ranging from about 10 to 16 preferably 10 to 12. The large nominal size catalyst preferably ranges from about 5 to about 7 U.S. Sieve mesh size. Further details of this preferred embodiment are disclosed in U.S. Ser. No. 160,524, filed on Feb. 26, 1988, now U.S. Pat. No. 4,834,865, the teachings of which are incorporated by reference.

Generally, the small nominal size hydrocracking catalyst is present in an amount ranging from about 5 to 70 wt. % of the total overall amount of catalyst used in this invention. Preferably, this amount ranges from about 10 to about 60 wt. %. Most preferably the second reaction zone consists of three catalyst beds wherein the catalyst in all three beds possesses a U.S. Sieve mesh size of about 10 to 12. In this connection preferably the first reaction zone consists of two catalyst beds wherein the the catalyst in both beds has a nominal particle size of about 5 to about 7 mesh (U.S. Sieve).

The amount of small nominal size hydrocracking catalyst used in the process of the invention can be limited in accordance with the desired overall pressure gradient. This amount can be readily calculated by those skilled in the art as explained in U.S. Pat. Nos. 3,796,655 (Armistead et al.) and 3,563,886 (Carlson et al.)

The present invention is described in further detail in connection with the following Example, it being understood that this example is for purposes of illustration and not limitation.

Example

The two-catalyst hydrocracking process of the invention was compared with an alternative two-catalyst process wherein the second zone catalyst contained a silica-alumina matrix and not an alumina matrix in the support component as stipulated by the present invention. In the present example "USY" designates an ultrastable type Y zeolite.

The process of the invention was tested in a reactor having reactor beds loaded as set out below:

| | wt. g. | V., cc | catalyst |
|---|---|---|---|
| beds 1 and 2 | 9.8 | 11.9 | NiW/Al-USY |
| beds 3-5 | 17.4 | 23.9 | CoMo/Al-USY |

The comparative process was carried out in a reactor loaded as set out below:

| | wt. g | V., cc | catalyst |
|---|---|---|---|
| beds 1 and 2 | 9.8 | 11.9 | NiW/Al-USY |
| beds 3-5 | 17.4 | 23.8 | CoMo/SiAl-USY |

All of the catalyst was mixed with inert alundum to improve flow distribution and maintain better temperature control in a catalyst to alundum weight ratio of about 1:2.

The comparative process and the process in accordance with the invention were used to convert a light catalytic cycle oil feedstock to naphtha and distillate products.

Both the comparative process and the process of the invention test runs were carried out on a "once-through" basis at 1250 psig, and a hydrogen flow rate of 12,000 SCFB. During the initial phase of each run, the weight hourly space velocity (WHSV) was 1.45, i.e., for the first 22 days of the comparative run and 18 days for the invention run. During the following 10 days for each run, the severity of the run conditions was increased by raising the space velocity to 1.95 for each run. Temperature was adjusted to maintain 77 wt. % conversion of the feed material boiling above 380° F. to material boiling below 380° F.

Table 1 below sets out the properties of the feedstock used in each test run.

TABLE 1

| Feed Properties | |
|---|---|
| API gravity | 21.9 |
| C, % | 89.58 |
| H, % | 10.37 |
| S, % | 0.55 |
| N, ppm | 485 |
| Total aromatics, wt % | 69.5 |
| Polyaromatics, wt % | 42.2 |
| Simulated distillation, °F. | |
| IBP, wt % | 321 |
| 10 | 409 |
| 25 | 453 |
| 50 | 521 |
| 75 | 594 |
| 90 | 643 |
| FBP | 756 |

The following Table 2 sets out the compositions of the respective catalysts.

TABLE 2

| Properties of Cracking Catalysts | NiW/ Al-USY | CoMo/ SiAl-USY | CoMo/ Al-USY |
|---|---|---|---|
| Chemical Composition, wt % | | | |
| $MoO_3$ | | 10.55 | 10.55 |
| $WO_3$ | 17.78 | | |
| NiO | 1.90 | | |
| CoO | | 2.5 | 2.5 |
| $Na_2O$ | .13 | .07 | .07 |
| $SO_4$ | .29 | .13 | .13 |
| Support Composition, wt % | | | |
| Silica | | | |
| Alumina | 65 | | 65 |

TABLE 2-continued

| Properties of Cracking Catalysts | NiW/ Al-USY | CoMo/ SiAl-USY | CoMo/ Al-USY |
|---|---|---|---|
| Silica-alumina | | 65 | |
| Crystalline molecular Sieve | 35 | 35 | 35 |
| Surface Properties | | | |
| S.A., $m^2/g$ | 350 | 384 | 380 |
| Unit Cell Size, Å | 24.51 | 24.52 | 24.52 |
| Crystallinity, % | 94 | 110 | 110 |
| Physical Properties | | | |
| Density, $lbs/ft^3$ | 49.7 | 45.5 | 45 |
| Crush Strength, lbs/mm | 7.4 | 4.5 | |
| Abrasion Loss, wt % (1 hr) | 1.2 | .4 | |

The following Table 3 sets out the selectivities for both the comparative process and the process of the invention corrected to the common conditions of 725° F. and 77 wt. % conversion of the material boiling above 380° F. to material boiling below 380° F. These "corrected selectivities" were calculated from "corrected yields." The method and equations used to calculate the "corrected" yields are set out at U.S. Pat. No. 3,923,638 (Bertolacini et al.) the teachings of which are incorporated by reference.

TABLE 3

CRACKING SELECTIVITY (WEIGHT %)
YIELDS CORRECTED TO 77% CONVERSION AND 725° F.)

| | Comparative Process | | Invention Process | |
|---|---|---|---|---|
| WHSV | 1.45 | 1.95 | 1.45 | 1.95 |
| Dry Gas | 5.01 | 4.88 | 4.70 | 4.10 |
| Butane | 12.01 | 12.31 | 11.22 | 10.79 |
| Pentane | 10.84 | 10.64 | 10.30 | 9.52 |
| Light Naphtha | 16.74 | 16.93 | 16.53 | 16.52 |
| Heavy Naphtha | 58.40 | 58.24 | 60.25 | 62.07 |
| Butane I/N | 1.35 | 1.19 | 1.24 | 1.11 |
| Pentane I/N | 2.89 | 3.65 | 2.46 | 2.86 |

The above Table clearly shows the advantages provided by the process of the invention. The heavy naphtha yield is increased by about 2 wt. % at the lower space velocity operation and by almost 4 wt. % at the higher space velocity operation over the comparative process. The increase in heavy naphtha yield occurred at the expense of less valuable products, dry gas, butanes, pentanes, and some light naphtha. A minor drawback to the process of the invention is the decrease in iso to normal ratios for butane and pentane.

The catalyst activities for the process of the invention and the comparative process required to maintain 77% conversion are shown in the FIGURE at both low and high space velocities. The activity difference in each case is about 1° F. or essentially negligible. This is in contradistinction to the teachings of U.S. Pat. No. 3,649,523 where a direct comparison of CoMo/SiAl-USY and CoMo/Al-USY catalysts each tested alone yielded a 5% lower activity for the CoMo/Al-USY catalyst.

Products from both the low severity and high severity comparative and invention runs were distilled and analyzed in detail. The following Tables 4 through 6 set out the results of these analyses.

TABLE 4

PRODUCT QUALITY

| | Comparative Process | | Invention Process | |
|---|---|---|---|---|
| WHSV | 1.45 | 1.95 | 1.45 | 1.95 |
| Naphtha | | | | |

TABLE 4-continued

| PRODUCT QUALITY | Comparative Process | | Invention Process | |
|---|---|---|---|---|
| API | 58.1 | 57.4 | 57.0 | 57.2 |
| % C | 86.08 | 86.27 | 85.78 | 86.50 |
| % H | 13.85 | 13.18 | 13.64 | 13.77 |
| S ppm | na | na | 10 | 8 |
| N ppm | na | na | <1 | <1 |
| Distillate | | | | |
| API | 35.8 | 33.8 | 35.7 | 34.7 |
| % C | 86.75 | 87.31 | 87.25 | 87.38 |
| % H | 12.40 | 12.40 | 12.57 | 12.47 |
| S ppm | na | na | 15 | 5 |
| N ppm | na | na | 2 | <1 |
| Total | | | | |
| API | 52.0 | 48.9 | 51.8 | 51.9 |
| % C | 86.56 | 86.63 | 86.70 | 86.69 |
| % H | 13.55 | 13.41 | 13.42 | 13.47 |

TABLE 5

| DISTRIBUTION OF $C_6$+ IN NAPHTHA (WEIGHT %) | Comparative Process | | Invention Process | |
|---|---|---|---|---|
| WHSV | 1.45 | 1.95 | 1.45 | 1.95 |
| Paraffins (Total) | 3.57 | 3.22 | 3.00 | 3.47 |
| p-6 | 1.52 | 1.40 | 1.54 | 1.51 |
| p-7 | .76 | .70 | .77 | .75 |
| p-8 | .49 | .47 | .51 | .49 |
| p-9 | .36 | .32 | .36 | .34 |
| p-10 | .27 | .25 | .26 | .25 |
| p-11 | .09 | .06 | .10 | .09 |
| p-12+ | .08 | .02 | .06 | .04 |
| Isoparaffins (Total) | 25.33 | 25.89 | 24.97 | 24.39 |
| i-6 | 7.17 | 8.8 | 7.09 | 7.32 |
| i-7 | 5.41 | 6.1 | 5.38 | 5.39 |
| i-8 | 4.36 | 4.73 | 4.50 | 4.34 |
| i-9 | 3.53 | 3.31 | 3.56 | 3.27 |
| i-10 | 2.91 | 2.16 | 2.82 | 2.50 |
| i-11 | 1.00 | .54 | 1.06 | .99 |
| i-12+ | .95 | .16 | .56 | .58 |
| Naphthenes (Total) | 44.74 | 39.89 | 43.22 | 41.26 |
| n-6 | 5.71 | 6.19 | 5.45 | 5.57 |
| n-7 | 11.40 | 11.28 | 10.79 | 10.63 |
| n-8 | 11.09 | 10.29 | 10.52 | 9.98 |
| n-9 | 7.97 | 7.37 | 8.15 | 7.62 |
| n-10 | 5.12 | 3.60 | 5.28 | 4.70 |
| n-11 | 1.76 | .90 | 1.98 | 1.75 |
| n-12+ | 1.69 | .26 | 1.05 | 1.01 |
| Aromatics (Total) | 26.30 | 30.96 | 28.23 | 30.91 |
| a-6 | 1.77 | 2.26 | 1.81 | 2.02 |
| a-7 | 6.06 | 7.86 | 6.75 | 7.00 |
| a-8 | 8.58 | 10.91 | 9.10 | 10.02 |
| a-9 | 6.59 | 7.22 | 6.91 | 7.65 |
| a-10 | 3.27 | 2.71 | 3.66 | 4.22 |
| a-11+ | .12 | 0.00 | 0.00 | 0.00 |
| Total | 99.94 | 99.96 | 100.02 | 100.03 |

TABLE 6

| RECYCLE PRODUCT PROPERTIES Mass Spectral Analysis | Comparative Process | Invention Process |
|---|---|---|
| WHSV | 1.45 | 1.45 |
| Saturates | 51.2 | 50.4 |
| Paraffins | 28.6 | 29.4 |
| Noncond Cycloparaffins | 12.9 | 12.1 |
| Cond Cyclopar 2-Ring | 9.1 | 8.5 |
| Cond Cyclopar 3-Rind | 0.6 | 0.4 |
| Aromatics | 48.8 | 49.6 |
| Mono- | 45.9 | 46.8 |
| Benzenes | 25.6 | 26.4 |
| Naphthenebenzenes | 20.2 | 20.3 |
| Dinaphthenebenzenes | 0.0 | 0.0 |
| Di- | 2.9 | 2.8 |
| Naphthalenes | 1.8 | 1.8 |
| Acenaphthenes, Ddzfurans | 1.1 | 1.0 |
| Fluorenes | 0.0 | 0.0 |

TABLE 6-continued

| RECYCLE PRODUCT PROPERTIES Mass Spectral Analysis | Comparative Process | Invention Process |
|---|---|---|
| Tri- | 0.0 | 0.0 |
| Phenanthrenes | 0.0 | 0.0 |
| Naphthenesphenanthrenes | 0.0 | 0.0 |
| Tetra- | 0.0 | 0.0 |
| Pyrenes | 0.0 | 0.0 |
| Chrysenes | 0.0 | 0.0 |
| Penta- | 0.0 | 0.0 |
| Perylenes | 0.0 | 0.0 |
| Dibenzanthracenes | 0.0 | 0.0 |
| Thiopheno- | 0.0 | 0.0 |
| Benzothiophenes | 0.0 | 0.0 |
| Dibenzothiophenes | 0.0 | 0.0 |
| Naphthaobenzothiophene | 0.0 | 0.0 |
| Unidentified | 0.0 | 0.0 |

The above Tables clearly show that the process of the invention affords a similar product quality as the comparative process. Table 4 shows that the API gravity, carbon and hydrogen values for both processes are essentially the same. The total concentration of paraffins and iso paraffins for both processes are also very similar. The distillate properties shown in Table 6 also show no product degradation with the process of the invention as compared to the comparative process.

What is claimed is:

1. A process for hydrocracking a hydrocarbon feedstock with hydrogen at hydrocracking conversion conditions in a plurality of reaction zones in series which comprises:

(a) contacting said feedstock in a first reaction zone with a first reaction zone catalyst comprising a nickel component and a tungsten component deposed on a support component consisting essentially of an alumina component and a y zeolite; and (b) contacting the effluent from said first reaction zone in a second reaction zone with a second reaction zone catalyst comprising a cobalt component and a molybdenum component deposed on a support component consisting essentially of an alumina component and a y zeolite.

2. The process of claim 1 wherein said alumina is gamma alumina.

3. The process of claim 1 wherein a portion of said plurality of reaction zones contains catalyst possessing a small nominal U.S. Sieve mesh size ranging from about 10 to about 16 and the remaining portion of the total amount of catalyst in said plurality of reaction zones located upstream of the catalyst of small nominal particle size, possesses a large nominal particle size greater than said small nominal size.

4. The process of claim 3 wherein said small nominal particle size ranges from about 10 to about 12 mesh (U.S. Sieve) and said large nominal particle size ranges from about 5 to about 7 mesh (U.S. Sieve).

5. The process of claim 1 wherein said first reaction zone catalyst contains said nickel component in an amount ranging from about 1.5 to about 5.0 wt. % and said tungsten component in an amount ranging from about 15 to about 25 wt. % both calculated as oxides and based on total first reaction zone catalyst weight, and wherein said second reaction zone catalyst contains said cobalt component in an amount ranging from about 1.5 to about 5 wt. % and said molybdenum component in an amount ranging from about 6 to about 15 wt. % both calculated as oxides and based on the total second reaction zone catalyst weight.

6. The process of claim 5 wherein said alumina is gamma alumina.

7. The process of claim 1 wherein a portion of said plurality of reaction zones contains catalyst possessing a small nominal U.S. Sieve mesh size ranging from about 10 to about 16 and the remaining portion of the total amount of catalyst in said plurality of reaction zones located upstream of the catalyst of small nominal particle size, possesses a large nominal particle size greater than said small nominal size.

8. The process of claim 7 wherein said small nominal particle size ranges from about 10 to about 12 mesh (U.S. Sieve) and said large nominal size ranges from about 5 to about 7 mesh (U.S. Sieve).

9. The process of claim 1 wherein said first reaction zone catalyst contains said nickel component in an amount ranging from about 1.5 to about 4.0 wt.% and said tungsten component in an amount ranging from about 15 to about 20 wt.% both calculated as oxides and based on total first reaction zone catalyst weight and wherein said second reaction zone catalyst contains said cobalt component in an amount ranging from about 2 to about 4 wt.% and said molybdenum component in an amount ranging from about 8 to about 12 wt.% both calculated as oxides and based on the total second reaction zone catalyst weight.

10. The process of claim 9 wherein a portion of said plurality of reaction zones contains catalyst possessing a small nominal U.S. Sieve mesh size ranging from about 10 to about 16 and the remaining portion of the total amount of catalyst in said plurality of reaction zones located upstream of the catalyst of small nominal particle size, possesses a large nominal particle size greater than said small nominal size.

11. The process of claim 10 wherein said small nominal particle U.S. Sieve mesh size ranges from about 10 to about 12 and said large nominal particle size ranges from about 5 to about 7 mesh (U.S. Sieve).

* * * * *